US009711309B2

(12) United States Patent
McCormick et al.

(10) Patent No.: US 9,711,309 B2
(45) Date of Patent: Jul. 18, 2017

(54) RELAY INCLUDING PROCESSOR PROVIDING CONTROL AND/OR MONITORING

(71) Applicant: EATON CORPORATION, Cleveland, OH (US)

(72) Inventors: James M. McCormick, Bradenton, FL (US); Patrick W. Mills, Bradenton, FL (US); Steven C. Schmalz, Franklin, WI (US)

(73) Assignee: EATON CORPORATION, Cleveland, OH (US)

( * ) Notice: Subject to any disclaimer, the term of this patent is extended or adjusted under 35 U.S.C. 154(b) by 233 days.

(21) Appl. No.: 14/375,985

(22) PCT Filed: Jan. 9, 2013

(86) PCT No.: PCT/US2013/020770
§ 371 (c)(1),
(2) Date: Jul. 31, 2014

(87) PCT Pub. No.: WO2013/137971
PCT Pub. Date: Sep. 19, 2013

(65) Prior Publication Data

US 2015/0028877 A1 Jan. 29, 2015

Related U.S. Application Data

(60) Provisional application No. 61/609,532, filed on Mar. 12, 2012.

(51) Int. Cl.

| | |
|---|---|
| ***H01H 50/00*** | (2006.01) |
| ***H01H 47/00*** | (2006.01) |
| ***H01H 47/22*** | (2006.01) |

(52) U.S. Cl.
CPC ..... *H01H 50/00* (2013.01); *H01H 47/002* (2013.01); *H01H 47/226* (2013.01); *H01H 2300/052* (2013.01)

(58) Field of Classification Search
CPC ..... H01H 50/00; G01R 31/34; H02H 7/06
(Continued)

(56) References Cited

U.S. PATENT DOCUMENTS 5,172,329 A * 12/1992 Rahman ..... H02H 7/0455 361/113
5,325,315 A 6/1994 Engel et al.
(Continued)

FOREIGN PATENT DOCUMENTS

EP 0 279 592 A2 8/1988

*Primary Examiner* — Jermele M Hollington
*Assistant Examiner* — Zannatul Ferdous
(74) *Attorney, Agent, or Firm* — Eckert Seamans; Philip Levy; Grant Coffield

(57) ABSTRACT

A relay includes a first terminal, a second terminal, a third terminal, a fourth terminal, separable contacts electrically connected between the first and second terminals, an actuator coil comprising a first winding and a second winding, the first winding electrically connected between the third and fourth terminals, the second winding electrically connected between the third and fourth terminals, a processor, an output, a first voltage sensing circuit cooperating with the processor to determine a first voltage between the first and second terminals, and a second voltage sensing circuit cooperating with the processor to determine a second voltage between the third and fourth terminals. The processor determines that the separable contacts are closed when the first voltage does not exceed a first predetermined value and the second voltage exceeds a second predetermined value and responsively outputs a corresponding status to the output.

12 Claims, 5 Drawing Sheets

(58) Field of Classification Search
USPC ..... 324/418
See application file for complete search history.

(56) References Cited

U.S. PATENT DOCUMENTS

| | | | | |
|---|---|---|---|---|
| 5,856,905 | A | 1/1999 | Eckel et al. | |
| 6,222,714 | B1 * | 4/2001 | Hoffman | H02H 3/006 361/62 |
| 6,297,640 | B1 | 10/2001 | Hayes | |
| 7,253,634 | B1 * | 8/2007 | Kasztenny | H02H 1/0092 324/509 |
| 2011/0046808 | A1 | 2/2011 | Kellis et al. | |

* cited by examiner

RELAY INCLUDING PROCESSOR PROVIDING CONTROL AND/OR MONITORING

CROSS REFERENCE TO RELATED APPLICATION

This application claims the benefit of U.S. Patent Application Ser. No. 61/609,532, filed Mar. 12, 2012, which is incorporated by reference herein.

BACKGROUND

Field

The disclosed concept pertains generally to electrical switching apparatus and, more particularly, to relays, such as, for example, aircraft relays.

Background Information

FIG. 1 shows a conventional electrical relay 2 including a movable contact 4, which makes or breaks a conductive path between main terminals A1 and A2. Terminals X1 and X2 electrically connect to solenoid actuator coil windings 6,8. On many relays, the actuator coil has two separate windings or a partitioned winding used to actuate closure of separable main contacts, such as 10, and to hold the separable main contacts 10 together in a relay closed or on state. The need for the two coil windings 6,8 is the result of the desire to minimize the amount of electrical coil power needed to maintain the relay 2 in the closed state.

A typical normally open relay has a spring (not shown) on its armature mechanism (not shown) that holds the separable main contacts 10 open. In order to initiate movement of the armature mechanism for closure, a relatively large magnetic field is generated to provide sufficient force to overcome the inertia of the armature mechanism and, also, to build up enough flux in the open air gap of its solenoid (not shown) to create the desired force. During closure motion of the armature mechanism, both coil windings 6,8 are energized to produce a sufficient magnetic field. After the main contacts 10 close, the reluctance of the magnetic path in the solenoid is relatively small, and a relatively smaller coil current is needed to sustain the force needed to hold the main contacts 10 together. At this point, an "economizer" or "cut-throat" circuit (not shown) can be employed to de-energize one of the two coil windings 6,8 to conserve power and to minimize heating in the solenoid.

The economizer circuit (not shown) is often implemented via an auxiliary relay contact 12 (E1-E2) that is physically driven by the same solenoid mechanism (not shown) as the main contacts 10. The auxiliary relay contact 12 simultaneously opens as the main contacts 10 close, thereby confirming complete motion of the armature mechanism. The added complexity of the auxiliary contact 12 and the calibration needed for the simultaneous operation makes this configuration relatively difficult and costly to manufacture.

Alternatively, the economizer circuit (not shown) can be implemented by a timing circuit (not shown) which pulses a second coil winding, such as 8, only for a predetermined period of time, proportional to the nominal armature mechanism operating duration, in response to a command for relay closure (i.e., a suitable voltage applied between terminals X1-X2). While this eliminates the need for an auxiliary switch, it does not provide confirmation that the armature mechanism has closed fully and is operating properly.

There is room for improvement in relays.

SUMMARY

This need and others are met by embodiments of the disclosed concept in which a relay comprises: a first terminal; a second terminal; a third terminal; a fourth terminal; separable contacts electrically connected between the first and second terminals; an actuator coil comprising a first winding and a second winding, the first winding electrically connected between the third and fourth terminals, the second winding electrically connected between the third and fourth terminals; a processor; an output; a first voltage sensing circuit cooperating with the processor to determine a first voltage between the first and second terminals; and a second voltage sensing circuit cooperating with the processor to determine a second voltage between the third and fourth terminals, wherein the processor is structured to determine that the separable contacts are closed when the first voltage does not exceed a first predetermined value and the second voltage exceeds a second predetermined value and to responsively output a corresponding status to the output.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the term "processor" shall mean a programmable analog and/or digital device that can store, retrieve, and process data; a controller; a computer; a workstation; a personal computer; a microprocessor; a microcontroller; a microcomputer; a central processing unit; a mainframe computer; a mini-computer; a server; a networked processor, or any suitable processing device or apparatus.

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

The disclosed concept is described in association with aircraft relays, although the disclosed concept is applicable to a wide range of electrical relays.

Figure 1:
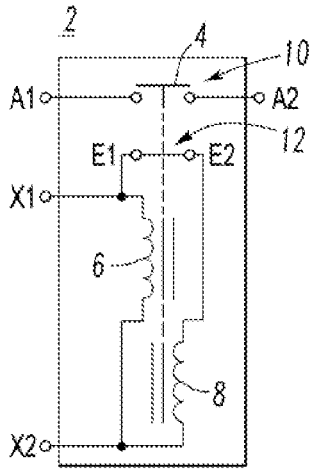
FIG. 1 PRIOR ART
FIG. 1 is a block diagram of a conventional electrical relay.
Figure 2:
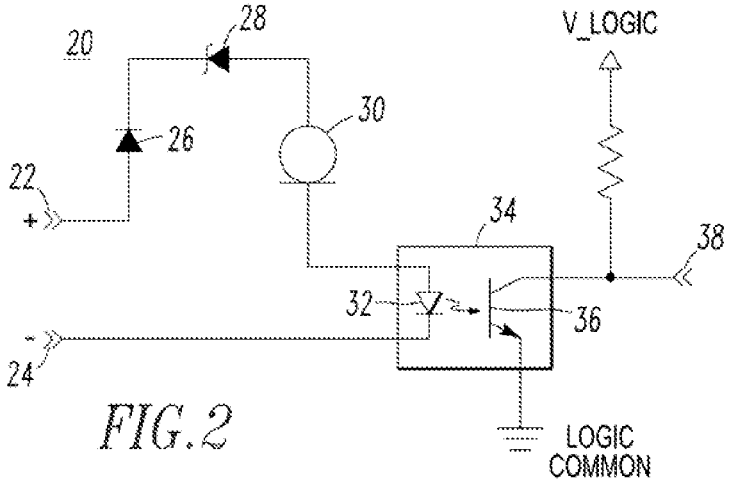
FIG. 2 is a block diagram in schematic form of a circuit for sensing a direct current (DC) voltage on relay terminals in accordance with an embodiment of the disclosed concept.

Referring to FIG. 2, by providing voltage sensors, such as 20, in order that the voltages at the main contacts 10 or load terminals (A1-A2) and the coil control terminals (X1-X2) of FIG. 1 are known, control of the relay 2 can be optimized and diagnostic information can be obtained. Specifically, if the voltages at the load terminals (A1-A2) are monitored, then the timing of contact closure can be determined and, hence, could be employed by an alternative mechanism to energize the two coil windings 6,8. For example and without limitation, a suitable processor, such as an embedded microcontroller or an analog control circuit, can be employed as a main controller to switch off a second coil winding (e.g., without limitation, employing a solid state power transistor; a switch; a signal relay). Furthermore, if the main controller knows the two sets of terminal voltages, then by employing suitable deductive logic, basic diagnostics and/or health monitoring of the relay 2 can be performed on a continuous basis. For example, if there is no voltage applied to the coil control terminals (X1-X2) (i.e., an open command), yet the load terminals (A1-A2) both have equal, but non-zero voltages on them, then this could indicate that the main contacts 10 are welded and are incapable of opening.

The example electronic circuit 20 of FIG. 2 can be employed to sense voltages across two input terminals 22,24. This circuit 20 can sense both AC and DC voltages, although only a positive voltage is acknowledged. If a difference in properly polarized voltage is present across the input terminals 22,24, then the series combination of rectifier diode 26, zener diode 28, current limiting diode 30 and input light emitting diode (LED) 32 of opto-isolator 34 begin to conduct. The diode 26 protects the opto-isolator LED 32 from reverse voltages and may be omitted if reverse voltages are not expected. The zener diode 28 sets a minimum voltage needed for detection. This can be employed to avoid false detection of a stray voltage or noise on the input terminals 22,24. The current limiting diode 30 controls the current such that a suitable current flows regardless of the input terminal voltage. The diode 30 can be replaced by a plurality of series-connected diodes (not shown) if terminal voltages are expected to exceed the diode's rated reverse voltage. In that case, as is conventional, a suitable voltage balancing resistor network (not shown) can be employed parallel to the series-connected diodes. The photo-transistor detector 36 of the opto-isolator 34 outputs a suitable logic output 38 to a processor (e.g., microprocessor) (not shown) to determine the state of the system operatively associated with the two input terminals 22,24. If the logic output 38 is employed to sense an alternating current (AC) voltage, the logic output 38 can be suitably filtered or time averaged since, otherwise, it is only active (i.e., logic low in this example) during the positive half cycle of an input AC voltage.

Figure 3A:
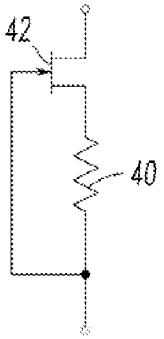
FIGS. 3A and 3B are block diagrams in schematic form of other current limiting circuits for the DC voltage sensing circuit of FIG. 2.
Figure 3B:
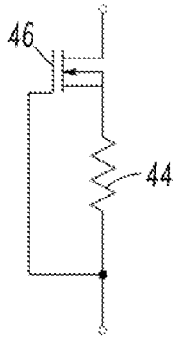

FIGS. 3A and 3B show a suitable combination of a resistor 40 and a JFET 42, and a resistor 44 and a depletion-mode MOSFET 46, respectively, that can be substituted for the current limiting diode 30 of FIG. 2.

Figure 4:
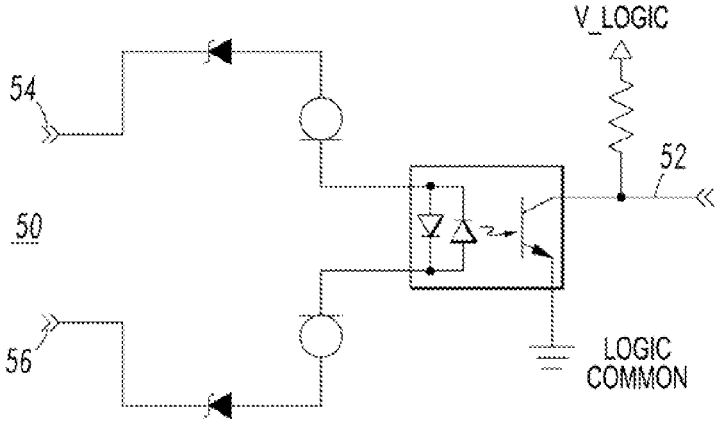
FIG. 4 is a block diagram in schematic form of a circuit for sensing alternating current (AC) or an inverted voltage on relay terminals in accordance with another embodiment of the disclosed concept.

FIG. 4 shows a bi-polar circuit 50 corresponding to the circuit 20 of FIG. 2. The bi-polar circuit 50 operates in the same manner, except that both positive and negative terminal voltages can generate an output logic signal 52. This allows detection of both positive and negative half-cycles of an AC signal at input terminals 54,56. Some suitable processing of the output logic signal 52 is employed by a monitoring circuit (not shown), in order to account for output interruptions near the AC waveform zero-crossings.

Figure 5:
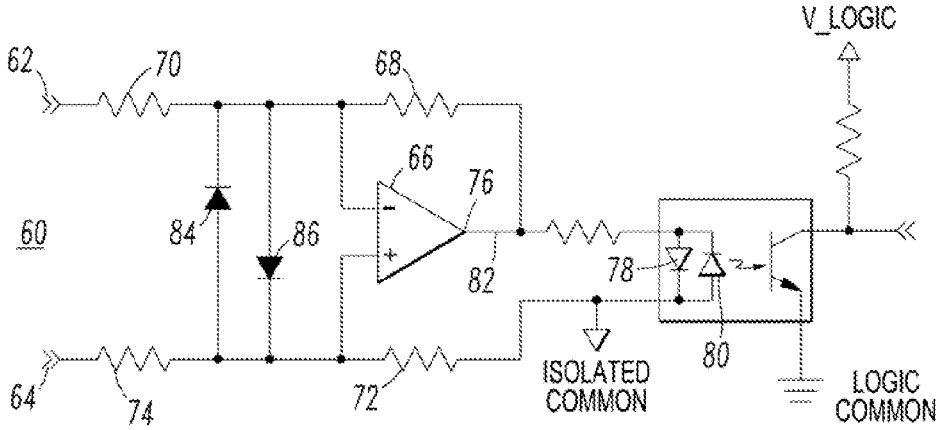
FIG. 5 is a block diagram in schematic form of a circuit for sensing a direct differential terminal voltage in accordance with another embodiment of the disclosed concept.

FIG. 5 shows another circuit 60 for sensing differential AC or DC voltages across two input terminals 62,64. The example circuit 60 has an advantage over the circuits 20,50 of FIGS. 2 and 4 and provides a relatively high input impedance with relatively less loading of the input terminals 62,64 (i.e., there are relatively very low leakage currents). The operational amplifier 66 is configured as a common differential amplifier. Resistors 68,70,72,74 are selected to provide an overall gain (or attenuation) of the amplifier stage, such that an appropriate voltage is presented at the op-amp output 76 for driving the opto-isolator input LEDs 78,80. The op-amp output signal 82 is proportional to the differential voltage on the input terminals 62,64. Since a minimum voltage is needed to bias the input LEDs 78,80 on, this circuit 60 provides no logic output with near zero input voltages. This circuit 60 also can avoid false detection of a stray voltage or noise on the input terminals 62,64. Diodes 84 and 86 clamp the input voltage protect the op-amp 66 from relatively high input voltage transients. The op-amp 66 employs an independent, isolated power supply (not shown) for power; however, if a plurality of circuits, such as 60, are employed to sense a plurality of other terminal pairs (not shown) at similar voltage levels, then a common power supply (not shown) can be employed for these circuits.

Figure 6:
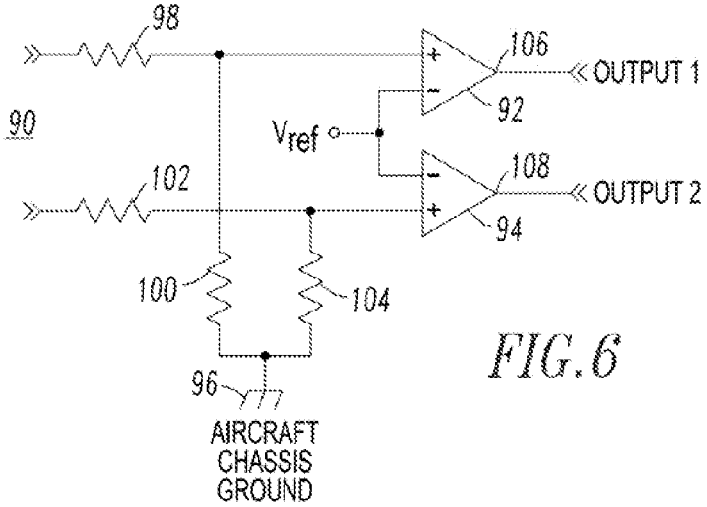
FIG. 6 is a block diagram in schematic form of a circuit for indirect differential DC terminal voltage sensing in accordance with another embodiment of the disclosed concept.

FIG. 6 shows a circuit 90 including two voltage comparators 92,94 to detect the presence of voltage on the main relay terminals (A1-A2). This circuit 90 senses the presence of voltage with respect to a common ground reference 96, such as for example and without limitation, the chassis of an aircraft (not shown) in which a corresponding relay (not shown) is installed. The example circuit 90 employs two resistor divider networks, 98,100 and 102,104, to indirectly present proportionately scaled voltages at the non-inverting (+) inputs of the two comparators 92,94. By comparing these voltages to a predetermined voltage reference, Vref, each of the two comparator outputs 106,108 represents the corresponding terminal input voltage and provides a high-level logic signal if the corresponding terminal input voltage is above a predetermined value as determined by the ratio of the corresponding resistor divider network resistances and the predetermined voltage reference Vref voltage. The example circuit 90 senses positive DC voltages.

Alternatively, AC voltages can be detected if diodes (not shown) are added at the inputs in series with the resistors 98 and 102, and processing of the output signals is provided as was discussed, above, in connection with the circuit 20 of FIG. 2. As with that circuit 20, only the positive half-cycle voltage is detected. If the monitoring circuit (not shown) is powered from a chassis-referenced power supply (not shown), then the same power supply can power the two comparators 92,94.

Figure 7:
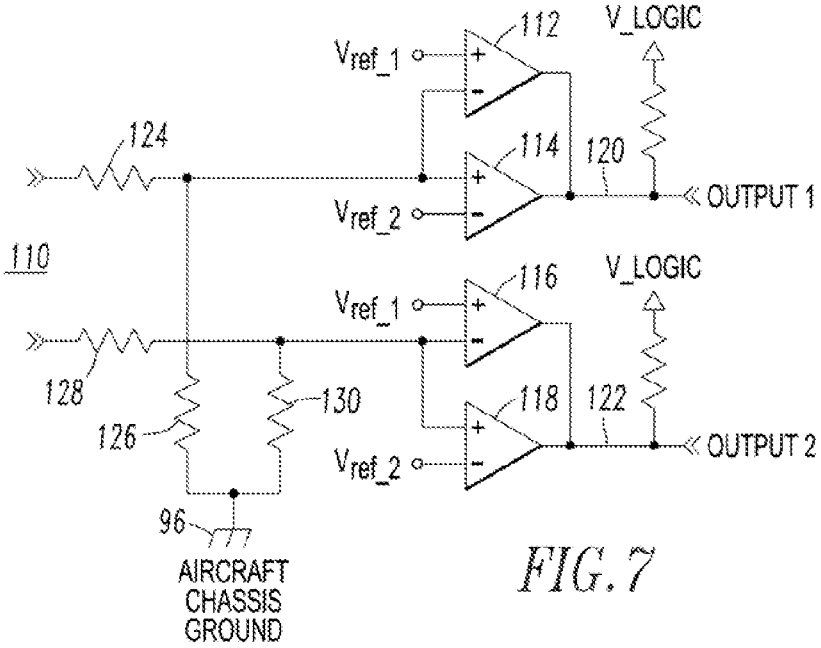
FIG. 7 is a block diagram in schematic form of a circuit for indirect differential AC or inverted terminal voltage sensing in accordance with another embodiment of the disclosed concept.

FIG. 7 shows a window comparator-based sensing circuit 110, which can sense AC voltages. This circuit 110 works similar to the circuit 90 of FIG. 6, except that the comparators 112,114,116,118 are configured in pairs to produce logic-high outputs 120,122 when each corresponding input terminal voltage is near zero. The near zero range is determined by the ratios of the resistor divider networks, 124,126 and 128,130, and the voltage reference levels, Vref_1>0 and Vref_2<0. The example comparators 112,114,116,118 have open collector outputs in order to logic-OR their outputs to implement the window comparator function. Alternatively, the two outputs of each window comparator pair can employ an exclusive-OR discrete electronic logic gate (not shown) or the main controller circuit (not shown) can generate a single output signal that switches states only if both sensed input terminal voltages are unequal, as would be the case if the corresponding relay contacts (not shown) were open. As with the circuit 90 of FIG. 6, the power supply (not shown) of the main controller circuit (not shown) is referenced to the chassis ground 96.

the input terminal voltage is below a corresponding suitable predetermined threshold voltage for that terminal. These corresponding suitable predetermined threshold voltages can be the same, although upper and lower thresholds for each signal preferably allow for out-of-range parameter detection.

The controller module 142 can be any suitable processor, such as for example and without limitation, an embedded microcontroller circuit, digital logic circuitry and/or discrete analog components. The controller module 142 implements an economizer circuit function by direct control from output 143 of a suitable switch 148 electrically connected in series with the second pull-in solenoid coil winding 150. The switch 148 can be, for example and without limitation, a suitable signal electro-mechanical relay or a suitable semiconductor device, such as a transistor. The controller module 142 sends relay status information 152 by a suitable communication interface 154 to a power distribution unit (PDU), a main controller or a load management controller 156 (e.g., for a vehicle).

Example 1

A load terminal (A1-A2) differential voltage can be about 50 mV to about 175 mV when the separable contacts are closed in the presence of a suitable load current, while the load terminal A2 can be at about 0 mV when the separable contacts are open.

TABLE 1

| $V_{A1\text{-}GND}$ | $V_{A2\text{-}GND}$ | $V_{A1\text{-}A2}$ | $V_{X1\text{-}GND}$ | $V_{X2\text{-}GND}$ | $V_{X1\text{-}X2}$ | Information Deduced | Status |
|---|---|---|---|---|---|---|---|
| Low | Low | Low | Low | Low | Low | No power on input; Relay commanded open; Relay contact status: undetermined | No Fault |
| High | Low | High | Low | Low | Low | Power present at input; Relay commanded open; Relay contact status: open | No Fault |
| High | High | Low | Low | Low | Low | Power present at input and output; Relay commanded open; Relay contact status: possibly closed (failed or welded) | Fault |
| High | High | Low | Low | High | High | Power present at input and output; Relay command undefined (possible loss of connection at input); Relay contact status; possibly closed | Fault |
| Low | Low | Low | High | Low | High | No power on input; Relay commanded closed; Relay contact status: undetermined | No Fault |
| High | Low | High | High | Low | High | Power present at input; Relay commanded closed; Relay contact status: open (failed to close) | Fault |
| High | High | Low | High | Low | High | Power present at input and output (normal power to load); Relay commanded closed; Relay contact status: closed | No Fault |
| High | High | Low | High | High | Low | Power present at input and output; Relay commanded open (possible loss of connection at input); Relay contact status: closed | Fault |

Figure 8:
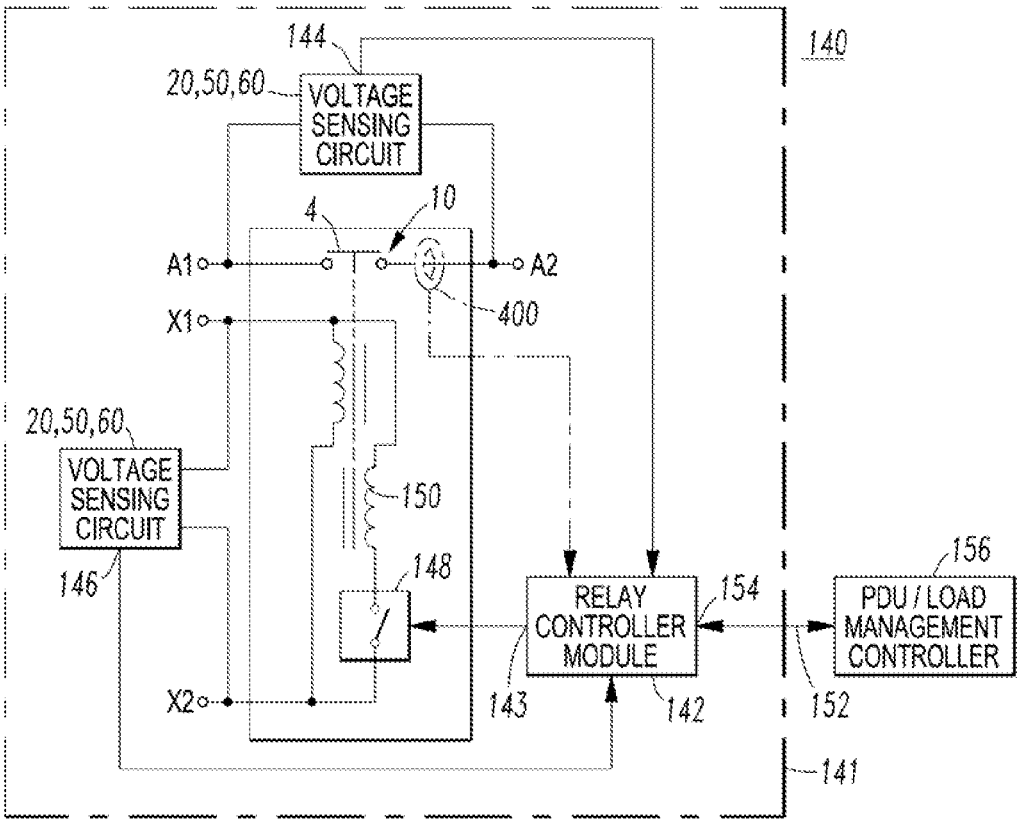
FIG. 8 is a block diagram in schematic form of a relay including two terminal voltage sensing circuits for the main contacts (or load terminals) and the coil control terminals in accordance with another embodiment of the disclosed concept.
Figure 9:
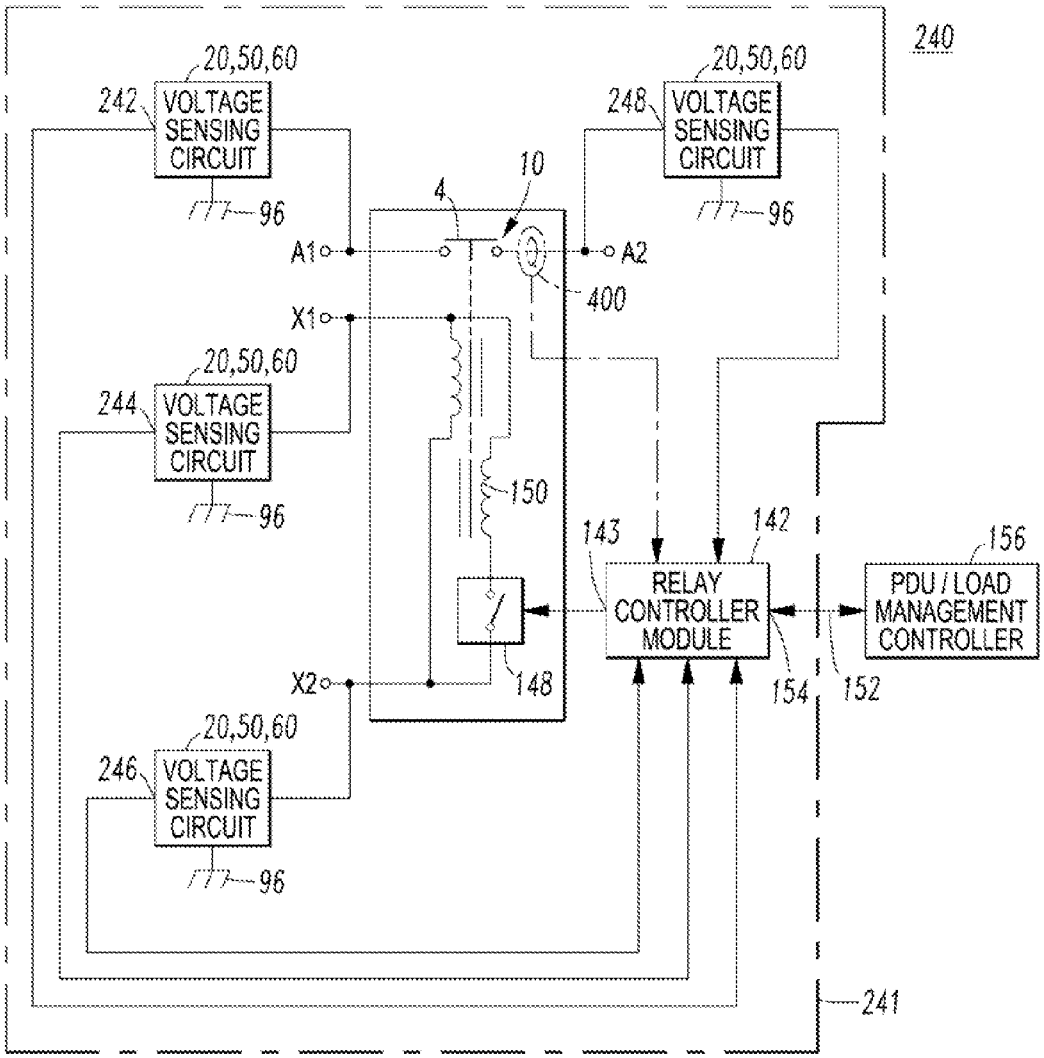
FIG. 9 is a block diagram in schematic form of a relay including two ground referenced terminal voltage sensing circuits for the main contacts (or load terminals) and the coil control terminals in accordance with another embodiment of the disclosed concept.
Figure 10:
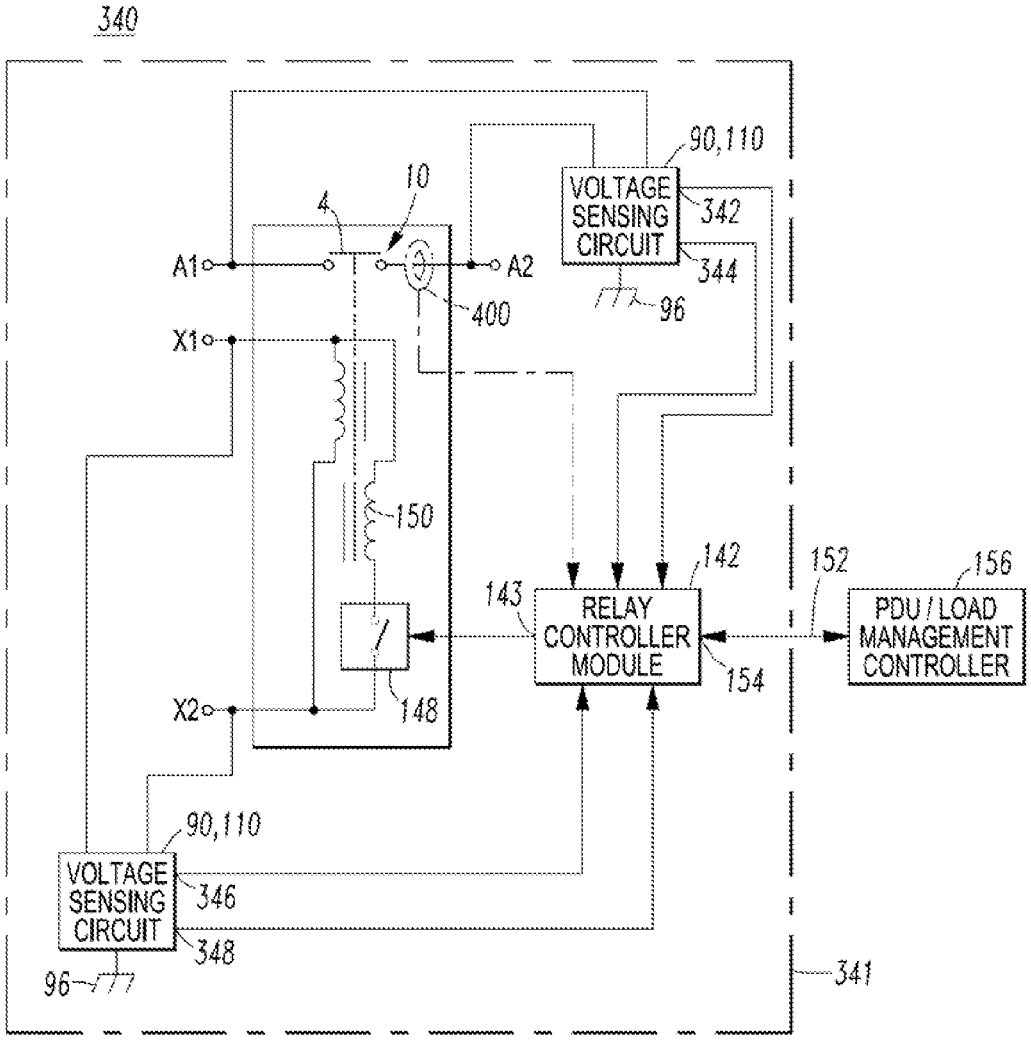
FIG. 10 is a block diagram in schematic form of a relay including two dual input/dual output terminal voltage sensing circuits for the main contacts (or load terminals) and the coil control terminals in accordance with another embodiment of the disclosed concept.

The voltage sensing circuits 20,50,60,90,110 of FIGS. 2 and 4-7 are non-limiting examples of circuits to sense relay terminal voltages, although a wide range of suitable voltage sensing circuits may be employed. FIG. 8-10 show examples of relay systems 140,240,340 including these voltage sensing circuits. In FIG. 8, both of the load terminals (A1-A2) and the coil control terminals (X1-X2) of relay 141 are monitored by one of these voltage sensing circuits, such as the direct differential terminal voltage sensing circuit 60 of FIG. 5. A relay controller module 142 receives the logic outputs 144,146 of the voltage sensing circuits 20,50 or 60 and uses suitable logic (e.g. without limitation, as shown in Table 1, below, which shows diagnostics with only voltage sensing) to determine the state of the relay main contacts 10. The term "V High" means that the input terminal voltage is above a corresponding suitable predetermined threshold voltage for that terminal, and the term "V Low" means that In Tables 1 and 2:

$V_{A1\text{-}GND}$ is voltage at terminal A1 with respect to ground (e.g. chassis ground);

$V_{A2\text{-}GND}$ is voltage at terminal A2 with respect to ground (e.g., chassis ground);

$V_{A1\text{-}A2}$ is differential voltage between terminals A1 and A2;

$V_{X1\text{-}GND}$ is voltage at terminal X1 with respect to ground (e.g., chassis ground);

$V_{X2\text{-}GND}$ is voltage at terminal X2 with respect to ground (e.g., chassis ground);

$V_{X1\text{-}X2}$ is differential voltage between terminals X1 and X2;

Current (Table 2 only) is current flowing between terminals A1 and A2;

Low means that voltage (or current) is below an expected minimum threshold; and

High means that voltage (or current) is above an expected minimum threshold.

FIG. 9 shows another relay system 240 in which the four terminal voltages for (A1, A2, X1 and X2) of relay 241 are sensed with respect to the vehicle chassis ground 96. The four discrete logic outputs 242,244,246,248 from the voltage sensing circuits 20,50 or 60 of FIG. 2, 4 or 5 are processed by the relay controller module 142 to determine the relay state in a similar manner as that of the relay system 140 of FIG. 8. It will be understood, however, that any suitable combination of direct differential sensing and/or ground referenced sensing may be employed, depending on the needs of the particular application.

FIG. 10 shows another relay system 340 including a relay 341 in which the dual input/dual output indirect or direct differential terminal voltage sensing circuits 90 or 110 of FIG. 6 or 7 are employed. The dual input differential terminal voltage sensing circuits 90 or 110 detect differential voltage with respect to ground 96 and the dual outputs 342,344 and 346,348 of each of the sensing circuits 90 or 110 are processed by the relay controller module 142.

Example 2

The disclosed concept replaces a relay auxiliary circuit with voltage sensing electronics. A suitably low voltage between the load terminals (A1-A2) of the relay allows the elimination of a conventional relay auxiliary circuit and provides a status to a PDU, a main controller or a load management controller, such as 156, which needs to know which relays of a power distribution system are on. Further, if the terminal set X1-X2 is high and the terminal set A1-A2 is low, then suitable electronics can be employed to transfer from the pull-in coil to the hold coil. This combines "coil control electronics" or a "cut-throat circuit" function with auxiliary switch functions. This eliminates various mechanical adjustments of the relay, and reduces the cost of the auxiliary switch and the cost of the coil control electronics.

Relays often use the circuit of FIG. 1 to switch between the pull-in and hold coils. The disclosed concept determines when there is a suitable high voltage (e.g., without limitation, 28 V) between the coil terminals and a suitable low voltage between the load terminals. Hence, the auxiliary circuit of the relay can be eliminated, which provides a significant cost and mechanical adjustment savings. Furthermore, if that is done, then these two signals can be used to "replace" the circuit of FIG. 1 that controls the coil. For example, if the relay has closed (as determined by the low voltage between the load terminals A1-A2) and the coil voltage shows that it had closed (as determined by the high voltage between the coil terminals X1-X2), then the relay controller module 142 (FIGS. 8-10) can switch to the "hold coil".

Example 3

Additionally, the disclosed voltage sensing circuits 20,50, 60,90,110 and relay systems 140,240,340 can employ a current sensor 400 (shown in phantom line drawing in FIGS. 8-10) structured to sense current flowing through the load terminals (A1-A2), then the relay can provide detailed load management information as shown in Table 2, which shows diagnostics with both voltage and current sensing. The term "I High" means that the sensed current is above a corresponding suitable predetermined threshold current, and the term "I Low" means that the sensed current is below a corresponding suitable predetermined threshold current. These corresponding suitable predetermined threshold currents can be the same, although upper and lower thresholds for each signal preferably allow for out-of-range parameter detection.

Suitable unique current and voltage thresholds can be employed to establish functional health limits for load current and voltage based upon insulation and/or contamination across the separable contacts.

TABLE 2

| $V_{A1\text{-}GND}$ | $V_{A2\text{-}GND}$ | $V_{A1\text{-}A2}$ | $V_{X1\text{-}GND}$ | $V_{X2\text{-}GND}$ | $V_{X1\text{-}X2}$ | Current | Information Deduced | Status |
|---|---|---|---|---|---|---|---|---|
| Low | Low | Low | Low | Low | Low | Low | No power on input; Relay commanded open; Relay contact status: undetermined | No Fault |
| Low | Low | Low | Low | Low | Low | High | Relay commanded open; Possible sensor failure; Relay contact status: closed (possible failure or welded) | Fault |
| High | Low | High | Low | Low | Low | Low | Power present at input; Relay commanded open; Relay contact status: open | No Fault |
| High | Low | High | Low | Low | Low | High | Power present at input; Relay commanded open; Possible sensor failure; Relay contact status: undetermined | Fault |
| High | High | Low | Low | Low | Low | Low | Power present at input and output; Relay commanded open; Relay contact status: possibly closed (failed or welded) | Fault |
| High | High | Low | Low | Low | Low | High | Power present at input and output; Relay commanded open; Relay contact status: closed (failed or welded) | Fault |
| Low | Low | Low | High | Low | High | Low | No Power on input; Relay commanded closed; Relay contact status: undetermined | No Fault |
| Low | Low | Low | High | Low | High | High | Relay commanded closed; Possible sensor failure or source voltage collapse; Relay contact status: undetermined | Fault |
| High | Low | High | High | Low | High | Low | Power present at input; Relay commanded closed; Relay contact status: open (failed to close) | Fault |
| High | Low | High | High | Low | High | High | Relay commanded closed; Possible sensor failure; Relay contact status: undetermined (possible high resistance) | Fault |

TABLE 2-continued

| $V_{A1-GND}$ | $V_{A2-GND}$ | $V_{A1-A2}$ | $V_{X1-GND}$ | $V_{X2-GND}$ | $V_{X1-X2}$ | Current | Information Deduced | Status |
|---|---|---|---|---|---|---|---|---|
| High | High | Low | High | Low | High | Low | Power present at input and output (normal power to load); Relay commanded closed; Relay contact status: closed; Load no drawing current (possible load fault) | Fault |
| High | High | Low | High | Low | High | High | Power present at input and output (normal power to load); Relay commanded closed; Relay contact status: closed | No Fault |

Example 4

Non-limiting examples of current sensors, such as 400, include Hall effect sensors for DC applications; current transformers for AC load imbalance and ground fault detection; and shunts on, for example, a 270 VDC contactor with corresponding thermal measurement for linear compensation. Current sensors can be placed, for example and without limitation, on terminals or lugs, around conductors, or within contactor buss bars (e.g., Hall effect: shunt).

Example 5

The disclosed concept can be employed in connection with the following features: (1) determination of contactor "open/close" state and communication of the same to remote systems, such as 156 of FIGS. 8-10 (e.g., without limitation, electronic or solid state auxiliary contacts; coil and plunger sealing redundancy (e.g., the current profile of the coil can be monitored to ensure that the plunger seals the magnetic path)); (2) determination of contactor "on/off" response time (e.g., without limitation, this time can be employed to indicate contactor health; coil performance; change in response time over the life of the product; change in performance as compared to other indicators, such as on resistance); (3) contactor "on resistance" (e.g., without limitation, this resistance can be saved and/or used to evaluate initial factory build performance; heat generation versus wear; performance versus number of electrical cycles (e.g., without limitation, typical relays are rated for 50,000 or 100,000 cycles; depending upon the application, the wear versus number of electrical cycles may need to be de-rated, load de-rated, or the contactor size may need to be increased if the device does not meet failure/quality criteria); impact on contactor performance when subjected to in-rush loads, capacitive loads, or a rupture fault current; also, this resistance can be employed to alert the user of potential reliability concerns, advice for contactor replacement, and/or re-torque of the contactor mounting mechanism); (4) contactor "in-rush current limit" (e.g., without limitation, this value can be used to indicate a potential issue with a downstream load, such as a three-phase motor wearing out and causing a much higher than expected starting in-rush current; this value can be used as a warning only for early diagnostics, such as a warning only for early diagnostics, such as a pump load wearing out or being in need of service); (5) contactor "over current" (e.g., this value ($I^2T$) can be used to provide protection and replace in-line fuses in power distribution units; protection against relatively large feeder short circuit faults); (6) contactor "over temperature" (e.g., without limitation, this temperature can be used to provide a nearly linear $I^2T$ trip curve on a contactor by compensating for changes in resistance with changes in temperature and current; can be used as an input to a processor (e.g., a microcontroller) when sensing current using a shunt: can be taken on the contactor coil to provide a health measurement (e.g., checking for shorted coil windings; checking for a pull-in coil staying on as a result of, for example, a bad cut-throat circuit)); (7) contactor "power factors" (e.g., without limitation, the values can be employed to monitor power conditions on an aircraft and regulate the power within the power distribution unit delivering clean power to other aircraft systems/loads); (8) contactor "bounce" (e.g., without limitation, this parameter can be used to indicate contact wear; contamination; spring wear; misadjusted wear allowance; contactor nearing the end of useful life); (9) relay pull-in voltage; and (10) relay drop-out voltage.

Example 6

Relay separable contacts, such as 10, usually start with a contact voltage drop (CVD) of about 50 mV to about 60 mV between A1 and A2 when fully closed at rated current. Typical relay specifications allow a change of CVD over life to about 100 mV, 125 mV or 150 mV. Loading on the separable contacts during use is usually about 50% of rating up to about 100% continuous; this concerns how relays or contactors are designed into systems and how they are typically loaded with current as compared to the maximum device rating. A relatively lower contact force corresponds to a relatively higher CVD. The load terminal voltage is essentially zero when the contacts are open. By monitoring the relay timing, when the A1-A2 voltage changes state to the CVD, resulting from the X1-X2 voltage, the voltage for pick-up and drop out and the relay timing can be determined. The ability to compare the A1-A2 voltage versus the X1-X2 voltage and timing allows the relay manufacturer to optimize the coil size, permits determining when to transfer from the pick-up coil to the hold coil, and permits determining the contact open or closed status.

As a result, a mechanical switch and/or a resistor-capacitor circuit are not needed for timing from the X1-X2 input to the state change of the relay separable contacts. The mechanical link from the main separable contacts to the auxiliary switch is one of various error-prone adjustments along with switching from the pull-in coil to the hold (or "release") coil. For example, the mechanical switch is usually spring actuated, which provides another force that the coil must "overcome". Because of the lack of "precision" across broad environmental and voltage constraints, the "hold" timing is much broader than it "needs" to be and the coil has to be able to withstand the longer times.

In the disclosed concept, "coil control" electronics or timing circuits are used instead of mechanical adjustments. Mechanical wear would indicate/create a need for a relatively higher pick-up voltage to close the relay. As a result, a threshold can be set for when the pick-up voltage change is outside an acceptable range or trending to show wear.

Similarly, the drop-out voltage can be monitored. If more friction occurs, then this can be observed since the relay will hold closed at a relatively lower voltage. Also, the relay timing will change. As a result, a threshold can be set for when the drop-out voltage change is outside an acceptable range or trending to show wear.

While the example terminal voltage sensing circuits of FIGS. 2 and 4-7 include comparators and other similar circuits to generate a logic output indicative of the presence (or absence) of voltage with respect to a predetermined threshold, they do not provide an analog value that a processor may utilize to measure actual coil pick-up, drop-out or contact drop voltage levels. However, this functionality could be easily employed by providing selected analog signals generated internally in some of the circuits presented directly to the processor. For example, if the processor were implemented using a microprocessor, the microprocessor could employ an integral analog-to-digital (A/D) converter which could sample the analog signals from the sensing circuit to determine the actual terminal voltages for use in performing diagnostic functions. In the circuit of FIG. 5, an analog voltage of the output signal 82 at the output of operational amplifier 66 is essentially a voltage proportional to the differential voltages sensed at the input terminals 62,64. In the circuit of FIG. 6, the analog voltages present at the non-inverting inputs of comparators 92,94 are also proportional to sensed terminal voltages and could be sampled by an A/D converter. A similar approach could be employed with the circuit of FIG. 7.

In addition to determining wear by monitoring changes in operational voltages over a relay's life, changes in timing of the logic signals may also be used as indication of mechanism wear. For example, if the time period between detection of voltage application to the coil control terminals X1,X2 and the detection of appropriate voltages at relay terminals A1,A2 indicating contact closure increases, then this may be indicative of jamming or drag in the relay mechanism. A suitable predetermined maximum duration for this period may be determined for allowable relay performance, beyond which the relay may need to be inspected, serviced or replaced.

A thermistor or other suitable temperature sensor can be added to account for temperature effects. For example, the resistance of copper changes with temperature. The thermistor measures the temperature of the copper as an input to provide a linear signal when measuring current for overcurrent protection.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A relay comprising:

a first terminal;

a second terminal;

a third terminal;

a fourth terminal;

separable contacts electrically connected between said first and second terminals;

an actuator coil comprising a first winding and a second winding, the first winding electrically connected between said third and fourth terminals, the second winding electrically connected between said third and fourth terminals;

a processor;

an output;

a first voltage sensing circuit cooperating with said processor to determine a first voltage between said first and second terminals; and a second voltage sensing circuit cooperating with said processor to determine a second voltage between said third and fourth terminals, wherein said processor is structured and provided with logic that configures said processor to determine that said separable contacts are closed when the first voltage does not exceed a first predetermined value and the second voltage exceeds a second predetermined value and to responsively output a corresponding status to said output.

2. The relay of claim 1 wherein said processor is further structured to determine a failure of said separable contacts to close when the first voltage exceeds the first predetermined value and the second voltage exceeds the second predetermined value and to responsively output another corresponding status to said output.

3. The relay of claim 1 wherein said processor is further structured to determine a failure of said separable contacts to open when the first voltage does not exceed the first predetermined value and the second voltage does not exceed the second predetermined value and to responsively output another corresponding status to said output.

4. The relay of claim 1 wherein said processor is further structured to communicate the corresponding status from said output to another processor.

5. The relay of claim 1 further comprising:

a switch electrically connected in series with the second winding, the series combination of said switch and the second winding electrically connected between said third and fourth terminals, wherein said processor comprises an output structured to open and close said switch, and wherein said processor is structured to normally cause the output to close said switch, to determine when the first voltage does not exceed the first predetermined value and the second voltage exceeds the second predetermined value, and to responsively cause the output to open said switch.

6. The relay of claim 5 wherein the output is a first output; wherein said processor further comprises a second output; and wherein said processor is further structured to communicate the corresponding status from said second output to another processor.

7. The relay of claim 1 further comprising:

a current sensing circuit cooperating with said processor to determine a current flowing between said first and second terminals, wherein said processor is further structured to determine that said separable contacts are closed and power is flowing to a load when the first voltage does not exceed the first predetermined value, the second voltage exceeds the second predetermined value, and the current exceeds a third predetermined value, and to responsively output a corresponding status to said output.

8. The relay of claim 7 wherein said processor is further structured to determine that said separable contacts are closed and power is not flowing to a load when the first voltage does not exceed the first predetermined value, the second voltage exceeds the second predetermined value, and the current does not exceed the third predetermined value, and to responsively output another corresponding status to said output.

9. The relay of claim 7 wherein said processor is further structured to determine a failure of said separable contacts to close when the first voltage exceeds the first predetermined value, the second voltage exceeds the second predetermined value, and the current does not exceed the third predetermined value, and to responsively output another corresponding status to said output.

10. The relay of claim 7 wherein said processor is further structured to determine a failure of said separable contacts to open when the first voltage does not exceed the first predetermined value, the second voltage does not exceed the second predetermined value, and the current exceeds the third predetermined value, and to responsively output another corresponding status to said output.

11. The relay of claim 7 wherein said processor is further structured to determine a failure of said separable contacts to open and a failure of the current sensing circuit when the first voltage does not exceed the first predetermined value, the second voltage does not exceed the second predetermined value, and the current exceeds the third predetermined value, and to responsively output another corresponding status to said output.

12. The relay of claim 7 wherein said processor is further structured to communicate the corresponding status from said output to another processor.

* * * * *